US010026364B2

(12) United States Patent
Sakai

(10) Patent No.: US 10,026,364 B2
(45) Date of Patent: Jul. 17, 2018

(54) LIFE PREDICTION METHOD, COMPUTER READABLE MEDIA INCLUDING LIFE PREDICTION PROGRAM, AND LIFE PREDICTION DEVICE

(71) Applicant: EIZO Corporation, Ishikawa (JP)

(72) Inventor: Yoshikazu Sakai, Ishikawa (JP)

(73) Assignee: EIZO Corporation, Ishikawa (JP)

( * ) Notice: Subject to any disclaimer, the term of this patent is extended or adjusted under 35 U.S.C. 154(b) by 148 days.

(21) Appl. No.: 15/107,195

(22) PCT Filed: Jan. 17, 2014

(86) PCT No.: PCT/JP2014/050736
§ 371 (c)(1),
(2) Date: Jun. 22, 2016

(87) PCT Pub. No.: WO2015/098132
PCT Pub. Date: Jul. 2, 2015

(65) Prior Publication Data

US 2017/0032745 A1 Feb. 2, 2017

(30) Foreign Application Priority Data

Dec. 25, 2013 (JP) ..... 2013-267810

(51) Int. Cl.
*G09G 3/34* (2006.01)
*G09G 3/36* (2006.01)

(52) U.S. Cl.
CPC ..... *G09G 3/3413* (2013.01); *G09G 3/3406* (2013.01); *G09G 3/36* (2013.01); *G09G 2320/041* (2013.01); *G09G 2320/048* (2013.01)

(58) Field of Classification Search
CPC ..... G09G 2320/043; G09G 2320/045; G09G 2320/048
See application file for complete search history.

(56) References Cited

U.S. PATENT DOCUMENTS 5,644,654 A 7/1997 Onokera
8,059,070 B2 * 11/2011 Odawara ..... G09G 3/3233 345/76

(Continued)

FOREIGN PATENT DOCUMENTS

JP 33-249194 A 10/1988
JP 2000-163380 A 6/2000

(Continued)

OTHER PUBLICATIONS

Japanese Office Action dated Jul. 4, 2017, in connection with corresponding JP Application No. 2013-267810 (6 pgs., including English translation).

(Continued)

*Primary Examiner* — Patrick F Marinelli
(74) *Attorney, Agent, or Firm* — Maier & Maier, PLLC

(57) ABSTRACT

A life prediction method and device that can predict the life of a display device considering the differences between temperatures at measurements of the luminance of the display device. A monitor measures the luminance of the display screen using an optical sensor and measures the temperature around the display screen using a temperature sensor. A terminal device stores the measured luminances and temperatures in such a manner that the luminance and temperature are associated with each other. On the basis of the measured luminances and temperatures obtained by repeated measurements, the terminal device predicts the trend of changes in the luminance assuming that the temperatures at the measurements have been approximately constant, and predicts the life of the monitor on the basis of the predicted change trend.

8 Claims, 10 Drawing Sheets

(56) References Cited

U.S. PATENT DOCUMENTS

| | | | | |
|---|---|---|---|---|
| 9,019,319 | B2 * | 4/2015 | Wakatsuki | G09G 3/22 345/690 |
| 9,082,334 | B2 * | 7/2015 | Kimpe | G09G 3/3406 |
| 9,685,109 | B2 * | 6/2017 | Kimpe | G09G 3/3208 |
| 2005/0134525 | A1 * | 6/2005 | Tanghe | G06F 3/1446 345/1.1 |
| 2005/0280766 | A1 | 12/2005 | Johnson et al. | |
| 2006/0077136 | A1 | 4/2006 | Cok | |
| 2009/0033591 | A1 * | 2/2009 | Ikeya | G09G 3/3406 345/60 |
| 2010/0253715 | A1 * | 10/2010 | Odawara | G09G 3/3233 345/690 |
| 2011/0080437 | A1 * | 4/2011 | Yamashita | G09G 3/3233 345/690 |
| 2011/0128311 | A1 * | 6/2011 | Wakatsuki | G09G 3/22 345/691 |
| 2011/0242143 | A1 * | 10/2011 | Yamashita | G09G 3/3233 345/690 |
| 2012/0075358 | A1 * | 3/2012 | Shirai | G09G 3/3406 345/690 |
| 2012/0206426 | A1 * | 8/2012 | Sakakima | G09G 3/3426 345/207 |
| 2012/0235701 | A1 * | 9/2012 | Levermore | H01L 51/0031 324/762.01 |
| 2013/0187958 | A1 * | 7/2013 | Kimpe | G09G 3/3406 345/690 |
| 2014/0267465 | A1 * | 9/2014 | Yamashita | H04N 5/70 345/690 |
| 2015/0091951 | A1 | 4/2015 | Abe et al. | |
| 2015/0243216 | A1 * | 8/2015 | Chung | G09G 3/3233 345/214 |
| 2015/0269882 | A1 * | 9/2015 | Kimpe | G09G 3/3406 345/690 |
| 2016/0103171 | A1 * | 4/2016 | Tsutsui | G09G 3/006 257/40 |
| 2016/0104411 | A1 * | 4/2016 | Nathan | G09G 3/2007 345/690 |
| 2016/0210903 | A1 * | 7/2016 | Jun | G09G 3/3266 |
| 2017/0005268 | A1 * | 1/2017 | Ishii | G09G 3/006 |
| 2017/0032745 | A1 * | 2/2017 | Sakai | G09G 3/3406 |
| 2017/0039017 | A1 * | 2/2017 | Sakai | G06Q 50/10 |

FOREIGN PATENT DOCUMENTS

| | | | |
|---|---|---|---|
| JP | 2003-208992 | A | 7/2003 |
| JP | 2004-037258 | A | 2/2004 |
| JP | 2007-011246 | A | 1/2007 |
| JP | 4372733 | A | 1/2007 |
| JP | 2007-240801 | A | 9/2007 |
| JP | 2008-309895 | A | 12/2008 |
| JP | 2010203919 | A | 9/2010 |
| JP | 2010-224092 | A | 10/2010 |
| JP | 2011-209480 | A | 10/2011 |
| WO | 2013157104 | A1 | 10/2013 |

OTHER PUBLICATIONS

International Search Report dated Apr. 1, 2014 in corresponding Application No. PCT/JP2014/050736; 2 pgs.

Extended European Search Report dated Nov. 28, 2016, including the Supplementary European Search Report and the European Search Opinion, in connection with corresponding EP Application No. 14874813.0 (16 pgs.).

* cited by examiner

LIFE PREDICTION METHOD, COMPUTER READABLE MEDIA INCLUDING LIFE PREDICTION PROGRAM, AND LIFE PREDICTION DEVICE

TECHNICAL FIELD

The present invention relates to a life prediction method, computer readable media including a life prediction program, and device that predict the life of a display device by predicting changes in a display-related characteristic value of the display device.

BACKGROUND ART

For example, the continuous use of a liquid crystal display device, which displays images using a liquid crystal panel and a backlight, reduces the amount of light of the backlight. Accordingly, the continuous use of the liquid crystal display device over a long period of time prevents the backlight from emitting light with recommended luminance. When such a situation occurs, the backlight or display device itself needs to be replaced. Such replacement requires not small cost and affects the asset management of the user of the display device. For this reason, there has been a demand to predict the life of display devices.

Patent Literature 1 proposes a life prediction system that uses, as a criterion for determining the life of a display device, the time point when the maximum amount of light of a backlight, which emits light through a liquid crystal panel, that is, the maximum luminance will fall below a predetermined critical luminance and calculates the time period over which the maximum luminance will remain within the critical luminance, on the basis of measured luminances of the display device, Lehmann's expression, and the like.

CITATION LIST

Patent Literature

[Patent Literature 1]
Japanese Patent No. 4372733

SUMMARY OF INVENTION

Technical Problem

The life prediction system disclosed in Patent Literature 1 predicts the life of a display device on the basis of Lehmann's expression. However, there are display devices, operating environments, and the like to which this life prediction method cannot be applied, and the life of such display devices or the life of a display device in such an environment may not be accurately predicted. The reason why the life is not accurately predicted is that ambient temperature has a large effect on a measured luminance of a display device. For example, when the luminance is measured using an optical sensor, the measured luminance is highly temperature-dependent. Also, the unevenness in display of a display device varies among temperatures. While the life prediction system disclosed in Patent Literature 1 only has to measure the luminance at at least two time points, that is, this life prediction system employs a simple prediction method, it does not consider the environment, which varies from moment to moment. If the luminance is measured, for example, when ambient temperature varies abruptly, the life prediction trend may depend on exceptional measurement results and thus the prediction accuracy may be impaired.

The present invention has been made in view of the foregoing, and an object thereof is to provide a life prediction method, computer readable media including a life prediction program, and device that can predict the life of a display device considering the differences between temperatures at measurements of a display-related characteristic value of the display device.

Solution to Problem

The present invention provides a method for predicting life of a display device on the basis of a display-related characteristic value of the display device. The method comprises:

a characteristic value measurement step of repeatedly measuring a characteristic value of the display device;

a temperature measurement step of measuring a temperature of the display device at the measurement in the characteristic value measurement step; and a prediction step of, on the basis of the measured characteristic values and temperatures obtained by repeated measurements, predicting a trend of changes in the characteristic values assuming that the temperatures at the measurements of the characteristic values have been a particular temperature.

The method for predicting the life of the present invention further comprises:

an approximation step of, from the measured characteristic values, deriving an approximation straight line or an approximation curve relating to correspondence between the characteristic values and measurement times of the characteristic values; and a re-approximation step of re-deriving an approximation straight line or an approximation curve from the approximation straight line or approximation curve derived in the approximation step and the measured characteristic values and temperatures, wherein the prediction step comprises predicting the trend of the changes in the characteristic values on the basis of the approximation straight line or approximation curve re-derived in the re-approximation step.

The method for predicting the life of the present invention further comprises:

a characteristic value error calculation step of calculating errors between the approximation straight line or approximation curve derived in the approximation step and the characteristic values measured in the characteristic value measurement step;

a temperature difference calculation step of calculating differences between the particular temperature and the temperatures measured in the temperature measurement step;

a maximum temperature difference extraction step of extracting a maximum temperature difference from the differences calculated in the temperature difference calculation step;

a maximum temperature difference time identification step of identifying the time when a measured temperature corresponding to the maximum temperature difference extracted in the maximum temperature difference extraction step has been measured;

a characteristic value error extraction step of extracting a characteristic value error calculated in the characteristic value error calculation step with respect to a characteristic value corresponding to the measurement time identified in the maximum temperature difference time identification step; and a correction step of correcting the characteristic values measured in the characteristic value measurement step on the basis of the maximum temperature difference extracted in the maximum temperature difference extraction step and the characteristic value error extracted in the characteristic value error extraction step, wherein the re-approximation step comprises re-deriving an approximation straight line or an approximation curve on the basis of the characteristic values corrected in the correction step.

In the method for predicting the life of the present invention, the re-approximation step comprises repeatedly deriving an approximation straight line or an approximation curve until the errors calculated in the characteristic value error calculation step satisfy a predetermined condition.

In the method for predicting the life of the present invention, the particular temperature is an average temperature of the temperatures measured in the temperature measurement step.

In the method for predicting the life of the present invention, the characteristic value measurement step comprises measuring the characteristic value of the display device using a sensor, the method further comprising:

a calibration time acquisition step of acquiring a calibration time of the sensor; and a grouping step of grouping the measured characteristic values and temperatures into a plurality of groups on the basis of the calibration time acquired in the calibration time acquisition step, wherein the prediction step comprises making a prediction for each of the groups obtained in the grouping step.

In the method for predicting the life of the present invention, the display device is a display device for displaying color images and has conversion information for color-converting an input image into an output image, the method further comprising:

an adjustment time acquisition step of acquiring the time when the conversion information has been adjusted; and a grouping step of grouping the measured characteristic values and temperatures into a plurality of groups on the basis of the adjustment time acquired in the adjustment time acquisition step, wherein the prediction step comprises making a prediction for each of the groups acquired in the grouping step.

In the method for predicting the life of the present invention, the prediction step comprises a merging step of merging the predictions made for the groups.

The present invention provides a life prediction program, included in a computer readable media, for causing a computer to predict life of a display device on the basis of a display-related characteristic value of the display device, the program causing the computer to:

acquire measured values obtained by repeatedly measuring a characteristic value of the display device and measuring a temperature of the display device at the measurement of the characteristic value; and on the basis of the acquired characteristic values and temperatures, predict a trend of changes in the characteristic values assuming that the temperatures at the measurements of the characteristic values have been a particular temperature.

The present invention provides a life prediction device for predicting life of a display device on the basis of a display-related characteristic value of the display device, the device comprising:

characteristic value acquisition means configured to acquire measured characteristic values obtained by repeatedly measuring a characteristic value of the display device;

temperature acquisition means configured to acquire measured temperatures obtained by measuring a temperature of the display device at the measurement of the characteristic value; and prediction means configured to, on the basis of the acquired characteristic values and temperatures, predict a trend of changes in the characteristic values assuming that the temperatures at the measurements of the characteristic values have been a particular temperature.

According to the present invention, the display-related characteristic value of the display device is measured, and the temperature of the display device is also measured. Examples of a characteristic value to be measured include various types of values from which the life of the display device can be predicted, including display intensities that can be measured on the display surface of the display device, such as the luminance and chromaticity, the luminance that can be measured near the backlight, and the amount of control of the backlight, from which the luminance, chromaticity, or the like can be estimated. The trend of changes in the characteristic values assuming that the temperatures at the measurements have been the particular temperature is predicted on the basis of the measured luminances and temperatures obtained by repeated measurements, and the life of the display device is predicted on the basis of the predicted change trend. For example, the display intensity of the display device, such as the luminance or chromaticity, is measured; the trend of changes in the display intensity of the display device is predicted on the basis of the measured display intensities and temperatures; the time when the display intensity will fall below a predetermined intensity is calculated on the basis of the predicted change trend; and this time is regarded as the life of the display device. Thus, it is possible to predict the life of the display device while reducing the dependence of the measured characteristic values on changes in the temperature of the display device.

Further, according to the present invention, information about the time when the characteristic value and temperature have been measured is stored, and an approximation straight line or approximation curve relating to the correspondence between the measured characteristic values obtained by repeated measurements and the time of the measurements is derived. Further, an approximation straight line or approximation curve is re-derived from the derived approximation straight line or approximation curve and the measured characteristic values and temperatures. Thus, the accuracy of the approximation straight line or approximation curve can be improved.

Further, according to the present invention, the errors between the derived approximation line and the measured characteristic values are calculated. Further, the differences between the particular temperature (e.g., the average temperature) and the measured temperatures are calculated, and a maximum temperature difference is extracted from the calculated differences. The time when a temperature corresponding to the maximum temperature difference has been measured is identified, and an error with respect to a characteristic value measured at this time is extracted. The characteristic values are corrected on the basis of the extracted error and the maximum temperature difference, and an approximation straight line or approximation curve is re-derived from the corrected characteristic values. Thus, it is possible to correct the characteristic values considering the error of the characteristic value measured at the time when the temperature difference is largest and to predict the life of the display device on the basis of the temperature-corrected characteristic values.

Further, according to the present invention, an approximation straight line or approximation curve is repeatedly re-derived using the corrected characteristic values. The re-derivation of an approximation straight line or approximation curve is repeated until the calculated errors satisfy the predetermined condition. Thus, it is possible to repeatedly derive an approximation straight line or approximation curve, to remove the effect of an exceptional characteristic value, and to increase the prediction accuracy of the life of the display device.

Further, according to the present invention, the characteristic value of the display device is measured using the sensor for detecting the characteristic value. When the sensor is calibrated, the characteristic value measured by the sensor may vary. For this reason, the calibration time of the sensor is acquired; the measured characteristic values are grouped into multiple groups using this calibration time as a boundary; and changes in the characteristic value are predicted for each group. Further, the display device that displays color images has a table used to color-convert the pixel value from an input image to an output image. When this table is adjusted, that is, when so-called monitor calibration is performed, the measured characteristic value may vary. For this reason, the time when the adjustment has been performed is acquired; the measured characteristic values are grouped into multiple groups using this adjustment time as a boundary; and changes in the characteristic value are predicted for each group.

The predictions made for the groups are merged, and the life of the display device is predicted. Thus, the prediction accuracy can be prevented from being reduced due to the effect of the calibration of the sensor, the adjustment of the color conversion table, or the like.

Advantageous Effects of the Invention

According to the present invention, the characteristic value and temperature of the display device are repeatedly measured; the trend of changes in the characteristic values assuming that the temperatures at the measurements have been the particular temperature is predicted on the basis of the measured characteristic values and temperatures; and the life of the display device is predicted on the basis of the predicted change trend. Thus, it is possible to predict the life of the display device while reducing the dependence of the characteristic value on temperature changes and thus to accurately predict the life of the display device.

DESCRIPTION OF EMBODIMENTS

Figure 1:
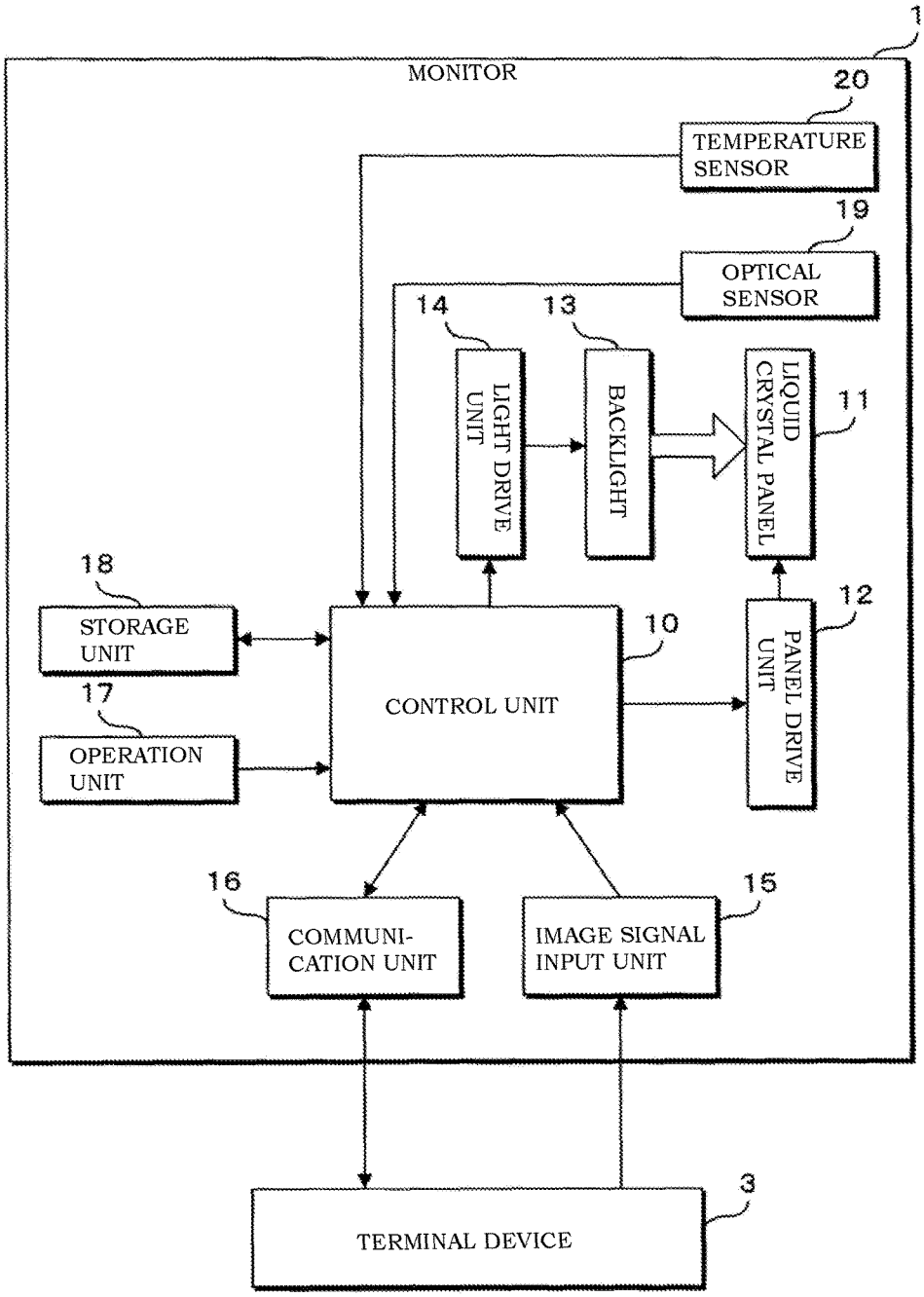
FIG. 1 is a block diagram showing the configuration of a monitor in a life prediction system according to the present embodiment.

Now, an embodiment of the present invention will be described specifically with reference to the drawings. FIG. 1 is a block diagram showing the configuration of a monitor in a life prediction system of the present embodiment. In the life prediction system of the present embodiment, a monitor 1 and a terminal device 3 are connected through an image signal cable, a communication cable, and the like. In the life prediction system of the present embodiment, the monitor 1 measures the luminance (a characteristic value) and temperature of the display screen, and the terminal device 3 acquires the measured luminance and temperature and predicts the life of the monitor 1.

The monitor 1 of the present embodiment is a so-called liquid crystal monitor, which displays images using a liquid crystal panel 11. The monitor 1 includes a control unit 10, a liquid crystal panel 11, a panel drive unit 12, a backlight 13, a light drive unit 14, an image signal input unit 15, a communication unit 16, an operation unit 17, a storage unit 18, an optical sensor 19, and a temperature sensor 20.

The control unit 10 includes an arithmetic processing unit, such as a central processing unit (CPU). The control unit 10 performs the drive control of the liquid crystal panel 11 based on a received image signal, the drive control of the backlight 13 according to the brightness setting or the like, and others by reading and executing a control program stored in the storage unit 18, a read only memory (ROM; not shown), or the like. The control unit 10 performs processes, such as the measurement of the luminance of the display screen using the optical sensor 19, the measurement of the temperature using the temperature sensor 20, and the transmission of the measured luminance and temperature to the terminal device 3.

The liquid crystal panel 11 is a display device in which multiple pixels are arranged in a matrix and which displays an image by changing the transmittance of the respective pixels on the basis of drive signals from the panel drive unit 12. The panel drive unit 12 generates drive signals for driving the pixels forming the liquid crystal panel 11, on the basis of an input image provided by the control unit 10 and then outputs the drive signals.

The backlight 13 includes a light source, such as a light-emitting diode (LED) or cold cathode fluorescent lamp (CCFL), and applies light to the back side of the liquid crystal panel 11. The backlight 13 emits light using a drive voltage or drive current provided by the light drive unit 14. The light drive unit 14 generates a drive voltage or drive current on the basis of a control signal from the control unit 10 and outputs it to the backlight 13. The control unit 10 determines the amount of drive of the backlight 13 on the basis of the brightness setting or the like received, for example, through the operation unit 17 and outputs a control signal corresponding to the determined amount of drive to the light drive unit 14. The control signal provided to the light drive unit 14 by the control unit 10 is, for example, a pulse width modulation (PWM) signal.

The image signal input unit 15 has a connection terminal to which an external device, such as the terminal device 3, is connected through an image signal cable. The terminal device 3 outputs an analog or digital image signal to the monitor 1 through the image signal cable. The monitor 1 receives the image signal from the terminal device 3 through the image signal input unit 15 and provides it to the control unit 10. The control unit 10 performs various types of image processing on the image signal and provides the resulting signal to the panel drive unit 12. Thus, an image based on the image signal received from the terminal device is displayed on the liquid crystal panel 11.

The communication unit 16 has a connection terminal to which an external device, such as the terminal device 3, is connected through a communication cable. The communication unit 16 communicates with the terminal device 3 in accordance with a standard, such as Universal Serial Bus (USB). Thus, the monitor 1 can transmit various types of information to the terminal device 3. The terminal device 3 can perform the operation control of the monitor 1, or the like by transmitting control information or the like to the monitor 1.

The operation unit 17 includes one or more switches disposed on the front edge, side surface, or the like of the case of the monitor 1. The operation unit 17 receives an operation of the user on these switches and notifies the control unit 10 of the received operation. For example, the user can change the brightness setting or color balance setting, which relates to the image display, using the operation unit 17. The control unit 10 stores a setting (a set value) received by the operation unit 17 in the storage unit 18 and controls the operation of the elements of the monitor 1 in accordance with this setting. For example, the control unit 10 determines the amount of drive of the backlight 13 in accordance with a brightness setting made by the user.

The storage unit 18 includes a non-volatile memory device, such as an electrically erasable programmable ROM (EEPROM) or flash memory. The control unit 10 can read and write various types of information from and to the storage unit 18. In the present embodiment, the storage unit 18 stores information, including the set values received by the operation unit 17 and the results of measurements made by the optical sensor 19 and temperature sensor 20.

The optical sensor 19 measures the luminance during the display of an image on the liquid crystal panel 11 and provides the measured luminance to the control unit 10. The optical sensor 19 is disposed, for example, on a frame-shaped portion surrounding the liquid crystal panel 11, of the case of the monitor 1. For example, the optical sensor 19 may be configured to, in response to the control unit 10 activating an actuator, motor, or the like, exit the case, move onto the display surface of the liquid crystal panel 11, and measure the luminance. The optical sensor 19 may also be configured to be detachable from the monitor 1. In this case, the user measures the luminance by mounting the optical sensor 19 on the display surface of the liquid crystal panel 11 and connecting it to the monitor 1 through a signal line or the like. While, in the present embodiment, the optical sensor 19 is configured to measure the luminance as a characteristic value of the monitor 1, it may be configured to measure other characteristic values, such as chromaticity.

Ideally, the optical sensor 19 is disposed on the display surface of the liquid crystal panel 11. However, the following configuration may be employed: the optical sensor 19 is disposed in a position other than on the display surface, for example, near the liquid crystal panel 11 or near the backlight 13; and the luminance of the display surface of the liquid crystal panel 11 is estimated from a luminance measured by the optical sensor 19. A configuration may also be employed in which the luminance of the display surface of the liquid crystal panel 11 is estimated from the amount of drive of the backlight 13 (in the case of a spontaneous light emission display panel, the amount of drive of the display panel). In this case, an estimation method disclosed in Japanese Patent No. 3974630 held by the inventor of the present application may be employed. If the luminance is estimated in any manner described above, the estimated luminance may be stored. Or, the following configuration may be employed: measured values are previously stored for estimation; and the stored measured values are read to estimate the luminance, as necessary.

The temperature sensor 20 is disposed, for example, on the periphery of the liquid crystal panel 11. In the present embodiment, the temperature sensor 20 is preferably disposed near the optical sensor 19. The temperature sensor 20 measures the temperature and provides the detection results to the control unit 10. The control unit 10 stores, in the storage unit 18, the luminance measured by the optical sensor 19 and the temperature measured by the temperature sensor 20 at the measurement of the luminance in such a manner that the luminance and the temperature are associated with each other.

The following configuration may be employed: the temperature sensor 20 is disposed in a position distant from the optical sensor 19; and the temperature near the optical sensor 19 is estimated from a temperature measured by the temperature sensor 20. The temperature sensor 20 may also be disposed on the case of the monitor 1 or on the terminal device 3 connected to the monitor 1. Or, the temperature may be estimated from the amount of drive of the backlight 13 by employing Japanese Patent No. 4673772 held by the present applicant. If the temperature is estimated in any manner described above, the estimated temperature may be stored. Or, the following configuration may be employed: measured values are previously stored for estimation; and the stored measured values are read to estimate the luminance, as necessary.

In the present embodiment, the control unit 10 of the monitor 1 includes, for example, a timer for counting the operation hours of the monitor 1 and measures the luminance using the optical sensor 19 each time the operation hours reach predetermined hours, for example, 100 hours. At this time, the control unit 10 displays a predetermined image (e.g., a white image) on part or all of the liquid crystal panel 11 and measures the luminance using the optical sensor 19 with the predetermined image displayed. The predetermined image may be displayed only in the range in which the luminance is measured using the optical sensor 19.

When the control unit 10 measures the luminance using the optical sensor 19, it measures the temperature using the temperature sensor 20 and stores the measured luminance and temperature in the storage unit 18 in such a manner that the luminance and temperature are associated with each other. The control unit 10 also stores, in the storage unit 18, information about the time when the measurement has been made and the brightness set value when the measurement has been made in such a manner that the time information and brightness set value are associated with the measured luminance and temperature. When the communication unit 16 is enabled to communicate with the terminal device 3, the control unit 10 reads these pieces of information from the storage unit 18 and transmits them to the terminal device 3. Instead of the brightness set value when the measurement has been made, the control unit 10 may store and transmit the amount of drive (e.g., the duty ratio of a PWM control signal provided to the light drive unit 14 by the control unit 10) of the backlight 13 corresponding to the brightness set value.

In the present embodiment, the optical sensor 19 outputs RGB values as the measurement results, and the control unit 10 converts the RGB values into XYZ values and regards the Y value as the measured luminance. To perform this conversion, the control unit 10 uses conversion information, such as a conversion table, conversion matrix, or conversion formula. The conversion information is stored in the storage unit 18. The optical sensor 19 of the monitor 1 can be calibrated. When the optical sensor 19 is calibrated, the conversion information stored in the storage unit 18 is modified. In the present embodiment, along with the measured luminances and temperatures, and the like, the conversion information stored in the storage unit 18 is transmitted to the terminal device 3. The terminal device 3 can determine whether the optical sensor 19 has been calibrated by comparing the previously transmitted conversion information and the current conversion information. Alternatively, the following configuration may be employed: the monitor 1 stores information about the time when the optical sensor 19 has been calibrated and transmits the time information to the terminal device 3. If the luminance is acquired by estimation as described above, the time point when a correlation value (a correction factor, etc.) used for an estimation calculation has been readjusted may be regarded as the calibration time.

In the present embodiment, the control unit 10 performs various types of image processing on an image signal inputted from the terminal device 3 to the image signal input unit 15 so as to generate a display image. The image processing performed by the control unit 10 includes the color conversion of the input image. Conversion information used in this process, such as a conversion table, conversion matrix, or conversion formula, is stored in the storage unit 18. The conversion information in the monitor 1 can be adjusted, that is, so-called "monitor calibration" can be performed on the monitor 1. When monitor calibration is performed, the conversion information is modified. In the present embodiment, along with the measured luminances and temperatures, and the like, the conversion information for color conversion stored in the storage unit 18 is transmitted to the terminal device 3. The terminal device 3 can determine whether the monitor 1 has been calibrated by comparing the previously transmitted conversion information and the current conversion information. Alternatively, the monitor 1 may be configured to store information about the time when it has been calibrated and to transmit the time information to the terminal device 3.

In the present embodiment, the backlight 13 of the monitor 1 can be replaced. The monitor 1 stores, in the storage unit 18, information about the time when the backlight 13 has been replaced. For example, the monitor 1 may be configured to, when it detects that the backlight 13 has been removed, store information about the time when the backlight 13 has been removed, in the storage unit 18. The monitor 1 may also be configured in such a manner that the operator which has replaced the backlight 13 inputs information about the time when the backlight 13 has been replaced, to the operation unit 17. In the present embodiment, along with the measured luminances and temperatures, and the like, the information about the time when the backlight 13 has been replaced stored in the storage unit 18 is transmitted to the terminal device 3.

Figure 2:
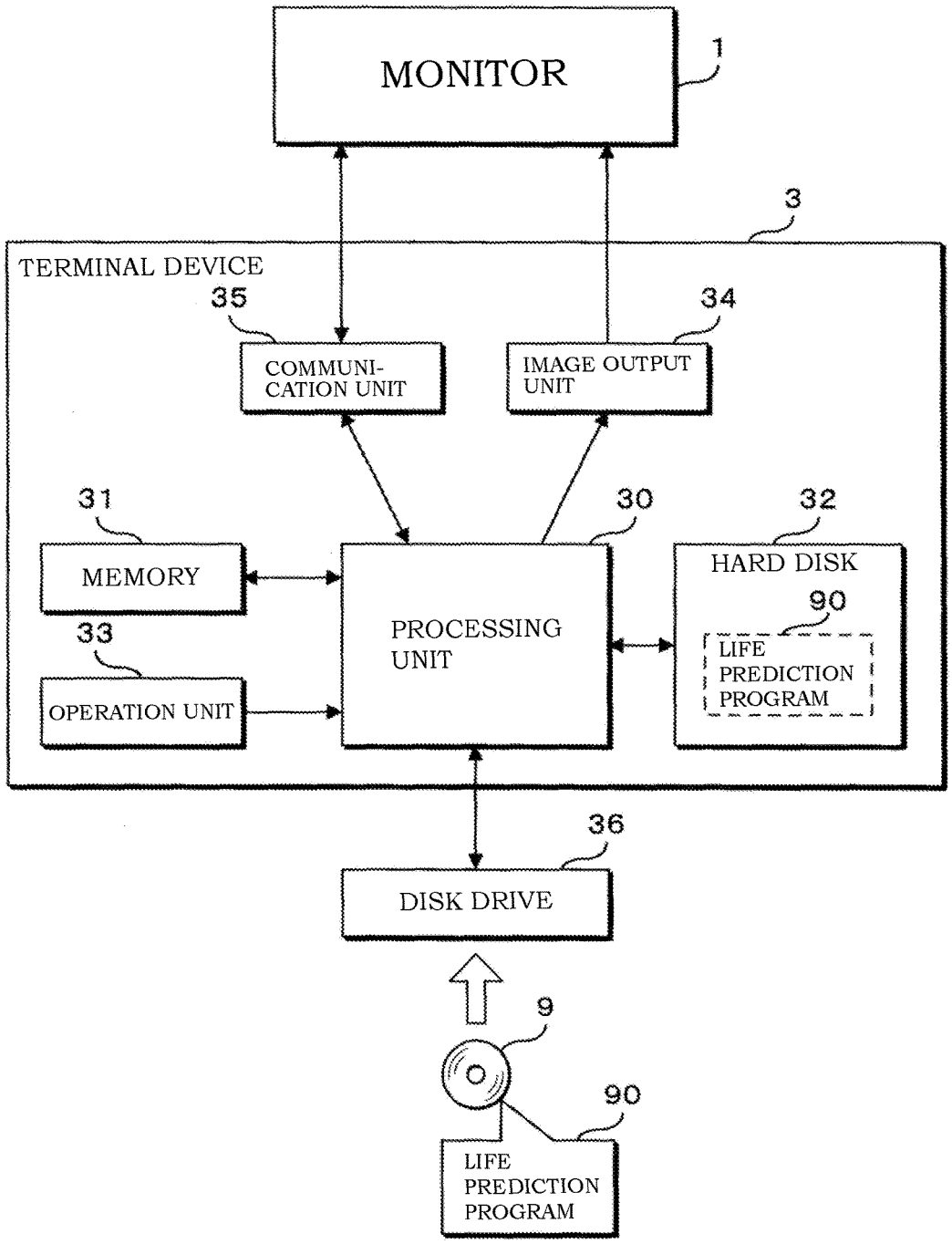
FIG. 2 is a block diagram showing the configuration of a terminal device.

FIG. 2 is a block diagram showing the configuration of the terminal device 3. The terminal device 3 includes a processing unit 30, a memory 31, a hard disk 32, an operation unit 33, an image output unit 34, a communication unit 35, and a disk drive 36. The terminal device 3 is a general-purpose computer, such as a personal computer (PC). The processing unit 30 of the terminal device 3 includes an arithmetic processing unit, such as a CPU, and performs various types of arithmetic processing by reading and executing a program stored in the hard disk 32. In the present embodiment, the processing unit 30 reads and executes a life prediction program 90 stored in the hard disk 32. Thus, the processing unit 30 predicts changes in the luminance of the monitor 1 and the life of the monitor 1 on the basis of the information acquired from the monitor 1, such as the measured luminances and temperatures.

The memory 31 includes a memory device, such as static random access memory (SRAM) or dynamic random access memory (DRAM), and temporarily stores various types of data resulting from the arithmetic processing by the processing unit 30. The hard disk 32 includes a magnetic disk drive or the like and stores various types of programs executed by the processing unit 30 and various types of data necessary to execute the programs. In the present embodiment, the hard disk 32 stores the life prediction program 90. The operation unit 33 includes devices, such as a mouse and a keyboard. It receives a user operation and notifies the processing unit 30 of the user operation. The image output unit 34 converts a display image generated by the processing unit 30 into analog or digital image signals suitable for the monitor 1 and outputs the image signals to the monitor 1. The communication unit 35 communicates with the monitor 1 through, for example, a communication cable conforming to the USB standard. The disk drive 36 is a disk drive that an optical disc 9, such as compact disc (CD) or digital versatile disc (DVD), is inserted into and reads a program and data stored in the optical disc 9. In the present embodiment, the terminal device 3 reads the life prediction program 90 stored in the optical disc 9 using the disk drive 36 and installs it into the hard disk 32.

For example, when the monitor 1 measures the luminance using the optical sensor 19 and measures the temperature using the temperature sensor 20, the processing unit 30 of the terminal device 3 of the present embodiment acquires the measurement results from the monitor 1. For example, the processing unit 30 may be configured to communicate with the monitor 1 at a predetermined timing, such as, at the start of the operation of the terminal device 3, and to, when the luminance and temperature have been measured and when the processing unit 30 has not acquired the measurement results, acquire the measurement results. The following configuration may also be employed: the monitor 1 measures the luminance and temperature and then notifies the terminal device 3 that the measurement is completed; and the processing unit 30 of the terminal device 3 acquires the measurement results in response to the notification. Instead of spontaneously measuring the luminance and temperature, the monitor 1 may be configured to measure the luminance in accordance with an instruction from the terminal device 3. In this case, the processing unit 30 of the terminal device 3 may give a measurement instruction to the monitor 1 at a predetermined timing and acquire the measurement results as a response to the instruction. The processing unit 30 acquires the measured luminance and temperature and information associated therewith from the monitor 1 and stores them in the hard disk 32.

For example, the terminal device 3 acquires the following information from the monitor 1:

- the date and time when information has been acquired
- the operation hours of the monitor 1
- measured luminance
- measured temperature
- measurement time
- the time when the backlight 13 has been replaced
- information for calculating a maximum luminance
- brightness set value (or, the amount of drive of the backlight 13)
- conversion information for the optical sensor 19 (or the time when the optical sensor 19 has been calibrated)
- information for color conversion (or, the time when monitor calibration has been performed)

Information, such as the date and time when information has been acquired, the measurement time, and the operation hours, is measured by the timer function, clock function, or the like of the monitor 1. The control unit 10 of the monitor 1 measures the time period in which the monitor 1 has been on or has been displaying images (the backlight 13 has been on) and regards the cumulative time period as the operation hours of the monitor 1. The time when the luminance and temperature have been measured is expressed as a time period relative to the operation hours. The same applies to the time when the backlight 13 has been replaced, the time when the optical sensor 19 has been calibrated, and the time when monitor calibration has been performed, and the like.

The processing unit 30 of the terminal device 3 acquires information from the monitor 1 at an appropriate timing and accumulates the acquired information in the hard disk 32. Note that when the backlight 13 is replaced in the monitor 1, the processing unit 30 may remove, from the hard disk 32, information acquired from the monitor 1 before the replacement.

The monitor 1 measures the luminance using the optical sensor 19 in a state in which the backlight 13 is being driven on the basis of the brightness setting set by the user. For this reason, the processing unit 30 of the terminal device 3 calculates a maximum luminance of the monitor 1 on the basis of the measured luminance, the information for calculating a maximum luminance, and the brightness set value acquired from the monitor 1. A maximum luminance can be calculated on the basis of Formula (1) below.

$$\text{maximum luminance} = \frac{\text{measured luminance}}{a \times \text{brightness setting} + b} \quad (1)$$

In Formula (1), a and b are factors for calculating a maximum luminance from the measured luminance and are the information for calculating a maximum luminance. The values of the factors a and b vary among monitors 1. For example, in the production process or the like of each monitor 1, factors a and b are previously calculated by measuring luminance change characteristics with respect to the brightness setting and stored in the storage unit 18 of the monitor 1. As a method for acquiring a maximum luminance, the processing unit 30 of the terminal device 3 may convert the measured luminance into a maximum luminance on the basis of Formula (1) and store the maximum luminance in the hard disk 32. In this case, it may not store the measured luminance, the information for calculating a maximum luminance, or the brightness setting in the hard disk 32. The processing unit 30 of the terminal device 3 may also be configured to previously store the measured luminance, the information for calculating a maximum luminance, and the brightness setting in the hard disk 32 and to calculate a maximum luminance in making a life prediction (to be discussed later). The following configuration may also be employed: the control unit 10 of the monitor 1 calculates a maximum luminance from the measured luminance and previously stores it in the storage unit 18; and the terminal device 3 acquires the maximum luminance from the monitor 1. Note that the method for acquiring a maximum luminance is not limited to those described above and may be other methods, for example, a method of maximizing the brightness setting and then measuring the luminance.

The processing unit 30 of the terminal device 3 performs the following life prediction process, for example, when the user gives an instruction to predict the life of the monitor 1 by operating the operation unit 33. First, the processing unit 30 reads information stored in the hard disk 32. At this time, the processing unit 30 only has to check the time when the backlight 13 has been replaced and to read information about the measurement results at the replacement time and later.

The processing unit 30 then checks the conversion information for the optical sensor 19 included in the read information and determines whether the optical sensor 19 has been calibrated, in accordance with whether the conversion information has been changed. If it determines that the optical sensor 19 has been calibrated, the processing unit 30 identifies the time when the calibration has been performed. Note that if the processing unit 30 can acquire, from the monitor 1, information about the time when the optical sensor 19 has been calibrated, the processing unit 30 need not identify the calibration time.

Similarly, the processing unit 30 checks the information for color conversion included in the read information and determines whether the monitor calibration has been performed, in accordance with whether the information for color conversion has been changed. If it determines that monitor calibration has been performed, the processing unit 30 identifies the time when the monitor calibration has been performed. Note that if the processing unit 30 can acquire, from the monitor 1, information about the time when monitor calibration has been performed, the processing unit 30 need not identify the monitor calibration time.

Figure 3:
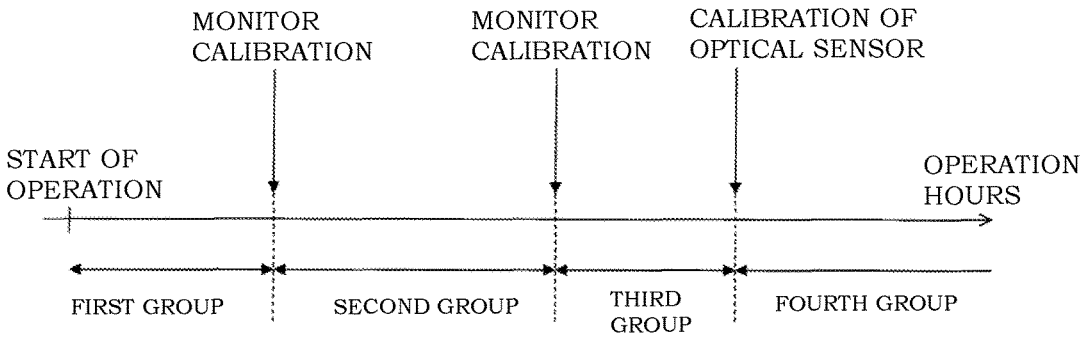
FIG. 3 is a schematic diagram showing a grouping process performed by the terminal device.

On the basis of the identified calibration time of the optical sensor 19 and the identified monitor calibration time, the processing unit 30 groups information, including the maximum luminances and measured temperatures of the monitor 1, into multiple groups. FIG. 3 is a schematic diagram showing a grouping process performed by the terminal device 3. FIG. 3 is a time chart whose horizontal axis represents the operation hours of the monitor 1 and in which monitor calibration times and a calibration time of the optical sensor 19 are shown by arrows. An example shown in FIG. 3 shows that the backlight 13 has not been replaced and that monitor calibration has been performed twice and the optical sensor 19 has been calibrated once in this order since the start of the operation of the monitor 1.

For example, the processing unit 30 of the terminal device 3 groups the information into a first group from the start of the operation of the monitor 1 to the first monitor calibration, a second group from the first monitor calibration to the second monitor calibration, a third group from the second monitor calibration to the first calibration of the optical sensor 19, and a fourth group from the first calibration of the optical sensor 19 and later. That is, the processing unit 30 groups the information into the groups using the timings when monitor calibration has been performed or the optical sensor 19 has been calibrated as boundaries.

Figure 4:
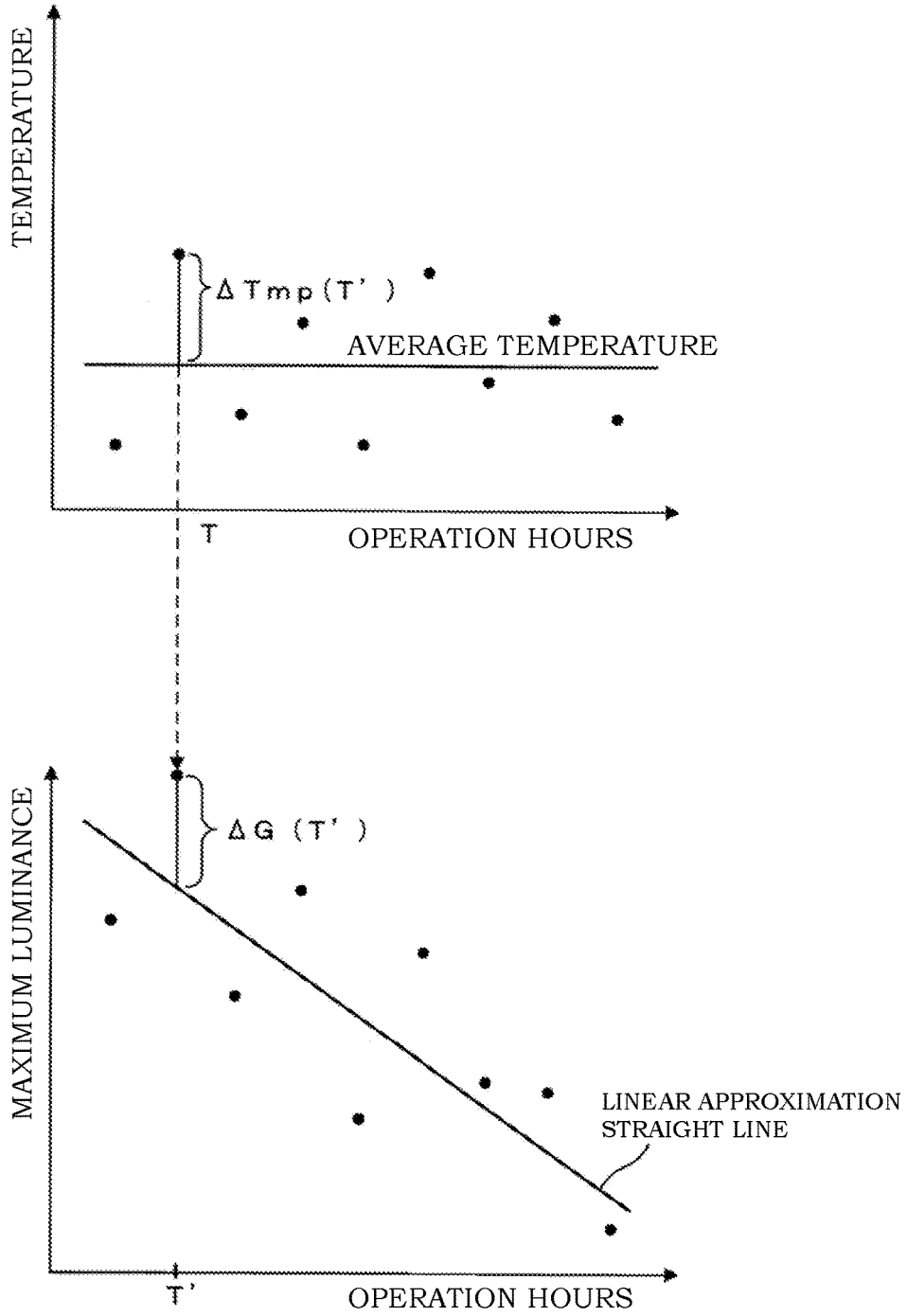
FIG. 4 is a schematic diagram showing a temperature correction process performed by the terminal device.

The processing unit 30 then temperature-corrects the maximum luminances of the monitor 1 for the respective groups. A temperature correction process for one group will be described below. FIG. 4 is a schematic diagram showing a temperature correction process performed by the terminal device 3. An upper part of FIG. 4 shows a graph showing the correspondence between the operation hours and the measured temperature. In the graph, the average of the measured temperatures is shown by a horizontal solid line. The processing unit 30 calculates the average of the temperatures measured by the monitor 1 and calculates the differences between the respective measured temperatures and the average temperature. The processing unit 30 makes a comparison among the calculated differences to extract a maximum difference (shown by ΔTmp(T') in FIG. 4), as well as identifies a measurement time T' when a temperature corresponding to the maximum difference has been measured.

A lower part of FIG. 4 shows a graph showing the correspondence between the operation hours and maximum luminances calculated from measured luminances. The processing unit 30 derives a linear approximation straight line from multiple sets of a maximum luminance and a measurement time stored in the hard disk 32. In the lower part of FIG. 4, the derived linear approximation straight line is shown by a solid line. Then, on the basis of the measurement time T' corresponding to the maximum difference identified from the measured temperatures, the processing unit 30 calculates the error (shown by ΔG(T') in FIG. 4) between a maximum luminance corresponding to a luminance measured at the measurement time T' and the derived linear approximation straight line.

The processing unit 30 then calculates and stores a temperature correction factor F=ΔG(T')/ΔTmp(T') on the basis of the maximum difference ΔTmp(T') and the error ΔG(T') of the corresponding maximum luminance. The processing unit 30 then temperature-corrects the maximum luminance using the temperature correction factor F and Formula (2) below. In Formula (2), G(T) represents a maximum luminance at the measurement time T; ΔTmp(T) represents the difference between a measured temperature at the measurement time T and the average temperature; and G'(T) represents a value obtained by temperature-correcting the maximum luminance at the measurement time T.

$$G'(T) = \frac{G(T)}{1 + \Delta Tmp(T) \times F} \tag{2}$$

The processing unit 30 then derives a linear approximation straight line from multiple sets of a corrected maximum luminance obtained by the temperature correction using Formula (2) and a measurement time. The processing unit 30 then calculates the errors between the respective corrected maximum luminances and the derived linear approximation straight line. The processing unit 30 then calculates and stores the square root of the mean of the squares of the calculated errors. Note that if the calculated root mean square is less than a threshold, that is, if the processing unit 30 can determine that the error of the maximum luminance is sufficiently small, the processing unit 30 may end the temperature correction process.

The processing unit 30 then changes the value of the temperature correction factor F and repeats the temperature correction of the maximum luminance, the derivation of a linear approximation straight line, the calculation of the errors, and the calculation of the root mean square. At this time, the processing unit 30 changes the value of the temperature correction factor F, for example, by increasing or reducing the temperature correction factor F by about ±1%. The processing unit 30 also changes the value of the temperature correction factor F in such a manner that a smaller root mean square is calculated.

The processing unit 30 then makes a comparison among the root mean square values calculated by repeating the above processes. If the current root mean square value is larger than the previous root mean square value, the processing unit 30 does not employ the current temperature-corrected maximum luminance but rather employs the previous temperature-corrected maximum luminance as the final correction results, ending the temperature correction process.

Figure 5A:
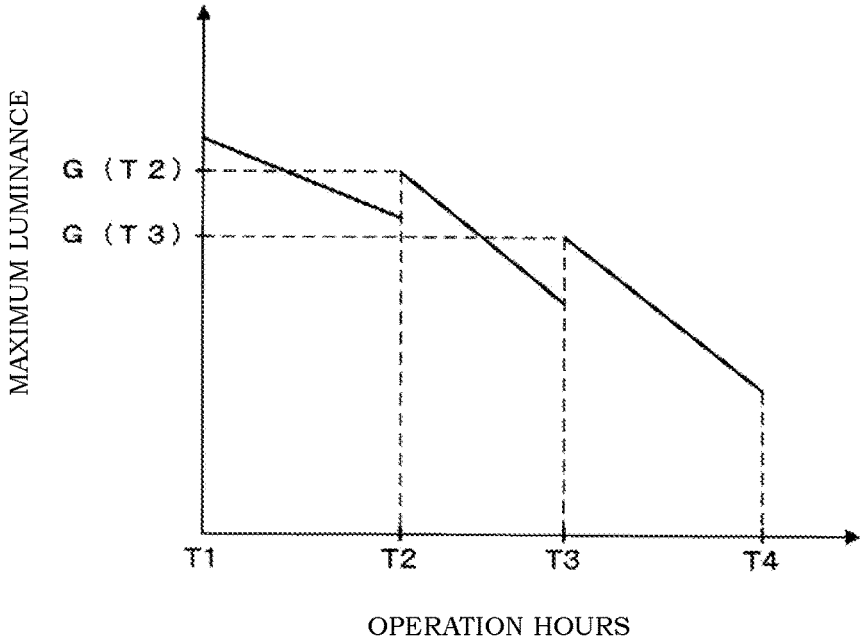
FIG. 5 includes schematic diagrams showing a merging process performed by the terminal device.

After temperature-correcting the maximum luminances for the respective groups in the above manner, the processing unit 30 merges the temperature correction results corresponding to the respective groups. FIG. 5 is a schematic diagram showing a merging process performed by the terminal device 3. FIG. 5A shows an example of multiple linear approximation straight lines obtained by temperature-correcting the maximum luminances for the respective groups. This example shows linear approximation straight lines obtained by temperature-correcting the maximum luminances for each of a first group from a measurement time T1 to a measurement time T2, a second group from the measurement time T2 to a measurement time T3, and a third group from the measurement time T3 to a measurement time T4.

Figure 5B:
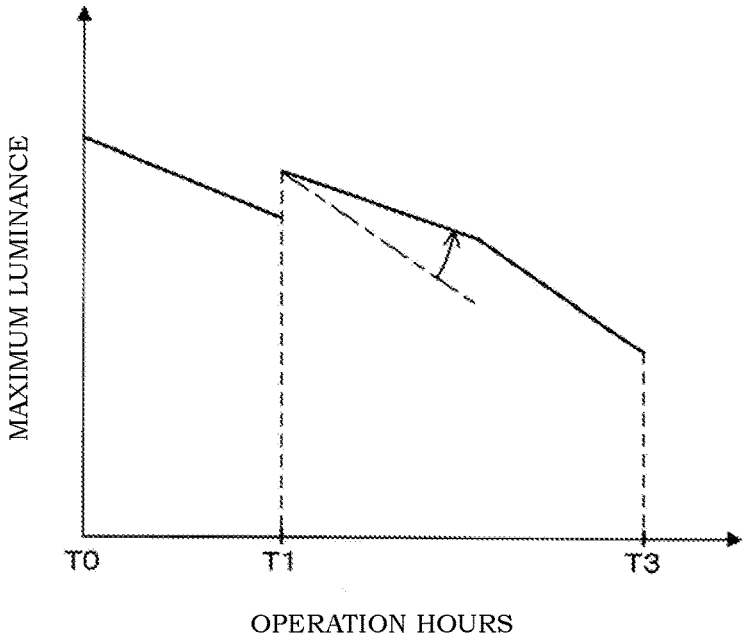

The processing unit 30 performs a merging process using Formulas (3) and (4) below. Formula (3) is an arithmetic expression for calculating a factor C assuming that the i-th group and the j-th group are merged. In Formula (3), Ti represents the first measurement time in the i-th group; Tj represents the first measurement time in the j-th group; G(Ti) represents a maximum luminance corresponding to Ti; and G(Tj) represents a maximum luminance corresponding to Tj. As shown in FIG. 5B, when the linear approximation straight line of the i-th group is connected to the linear approximation straight line of the j-th group, the inclination of the linear approximation straight line of the i-th group is changed. The calculated factor C represents the changed inclination of the linear approximation straight line of the i-th group. Formula (4) is an arithmetic expression for converting a maximum luminance G(T) in a set of the maximum luminance and a measurement time (G(T), T) of the i-th group so that the set of the maximum luminance and measurement time (G(T), T) adapts to the change in the inclination of the linear approximation straight line of the i-th group. G'(T) represents the changed maximum luminance.

$$C = \frac{G(Tj) - G(Ti)}{Tj\ Ti} \tag{3}$$

$$G'(T) = G(Ti) + (T - Ti) \times C \tag{4}$$

Merging of the second group and third group in the example shown in FIG. 5 will be described. The processing unit 30 calculates a maximum luminance G(T2) corresponding to the first measurement time T2 on the basis of the linear approximation straight line of the second group, calculates a maximum luminance G(T3) corresponding to the first measurement time T3 on the basis of the linear approximation straight line of the third group, and calculates the factor C on the basis of Formula (3). The processing unit 30 then converts the maximum luminance of the second group on the basis of the calculated factor C and Formula (4). Thus, as shown in FIG. 5B, the linear approximation straight line of the second group and the linear approximation straight line of the third group are connected.

The processing unit 30 performs similar merging processes with respect to the multiple groups, thereby connecting the linear approximation straight lines of all the groups. However, the linear approximation straight lines are connected in the form of a line graph. For this reason, the processing unit 30 derives one linear approximation straight line from the sets of a maximum luminance and a measurement time of all the groups. The one linear approximation straight line thus derived represents a final maximum luminance change trend of the monitor 1 predicted considering the differences between the temperatures at the measurements of the luminance.

The information is grouped into the groups using two types of times as boundaries: the time when the optical sensor 19 has been calibrated and the time when monitor calibration has been performed. In merging the groups, the processing unit 30 of the terminal device 3 of the present embodiment first merges groups obtained by grouping the information using the monitor calibration times as boundaries and derives a linear approximation straight line. The processing unit 30 then merges groups obtained by grouping the information using the calibration times of the optical sensor 19 and derives a final one linear approximation straight line.

The processing unit 30, which has derived the one linear approximation straight line in the merging process, calculates the time (critical operation hours) when the maximum luminance of the monitor 1 will fall below a predetermined critical luminance, on the basis of this linear approximation straight line. By subtracting the current operation hours from the calculated critical operation hours, the processing unit 30 can calculate the remaining operation hours of the monitor 1, that is, the life thereof. The processing unit 30 may calculate the year, month, and day when the critical operation hours are predicted to be reached, on the basis of, for example, the daily average operation hours of the monitor 1.

Figure 6:
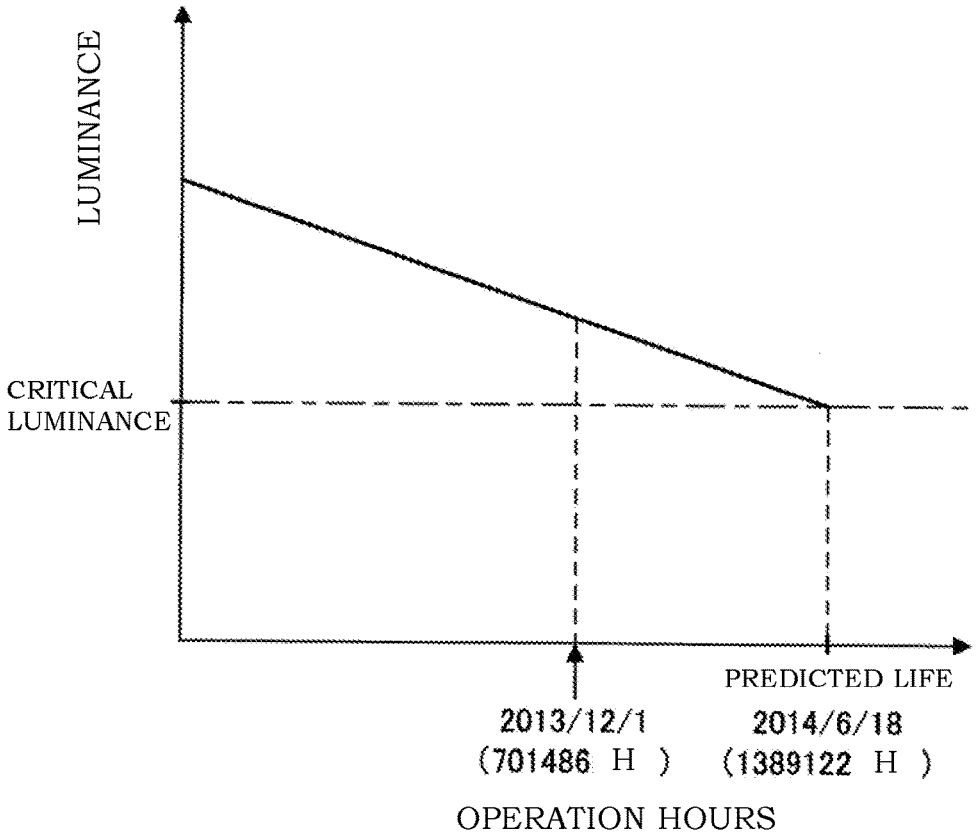
FIG. 6 is a schematic diagram showing an example display of a prediction made by the terminal device.

The processing unit 30 then displays information, including the trend of changes in the critical luminance and the life predicted with respect to the monitor 1, on the monitor 1. FIG. 6 is a schematic diagram showing an example display of the prediction made by the terminal device 3. The processing unit 30 of the terminal device 3 displays, on the monitor 1, an image of a graph whose vertical axis represents the luminance (the maximum luminance) of the monitor 1, whose horizontal axis represents the operation hours of the monitor 1, and which shows a straight line indicating the predicted maximum luminance change trend. The straight line shown in this graph is the final one linear approximation straight line obtained in the merging process. The processing unit 30 also displays a horizontal line (a dot-and-dash line in FIG. 6) indicating the critical luminance. Operation hours corresponding to the intersection of this horizontal line and the straight line indicating the maximum luminance change trend represent the time when the life of the monitor 1 will be reached. With respect to the time axis of the graph, the processing unit 30 displays marks, such as an arrow indicating the current time point, and information, such as the current date and operation hours. Also, with respect to the time when the life of the monitor 1 will be reached, the processing unit 30 displays character strings indicating the predicted life and information, such as the operation hours and the predicted date when the life will be reached.

The critical luminance may be a value preset on the monitor 1 and may also be any value set by the user of the monitor 1. While, in the example shown in FIG. 6, the maximum luminance change trend of the monitor 1 is shown in the form of a straight line, it may be shown in the form of a belt considering a prediction error. For example, the maximum luminance change trend may be shown in the form of a belt having an error range of about ±20% with respect to the predicted linear approximation straight line. The error range need not be constant. For example, after calculating variations in the actual measured values, the error range may be determined on the basis of the variations. The error range may also be the largest of the errors between the linear approximation straight line and the respective maximum luminances.

Figure 7:
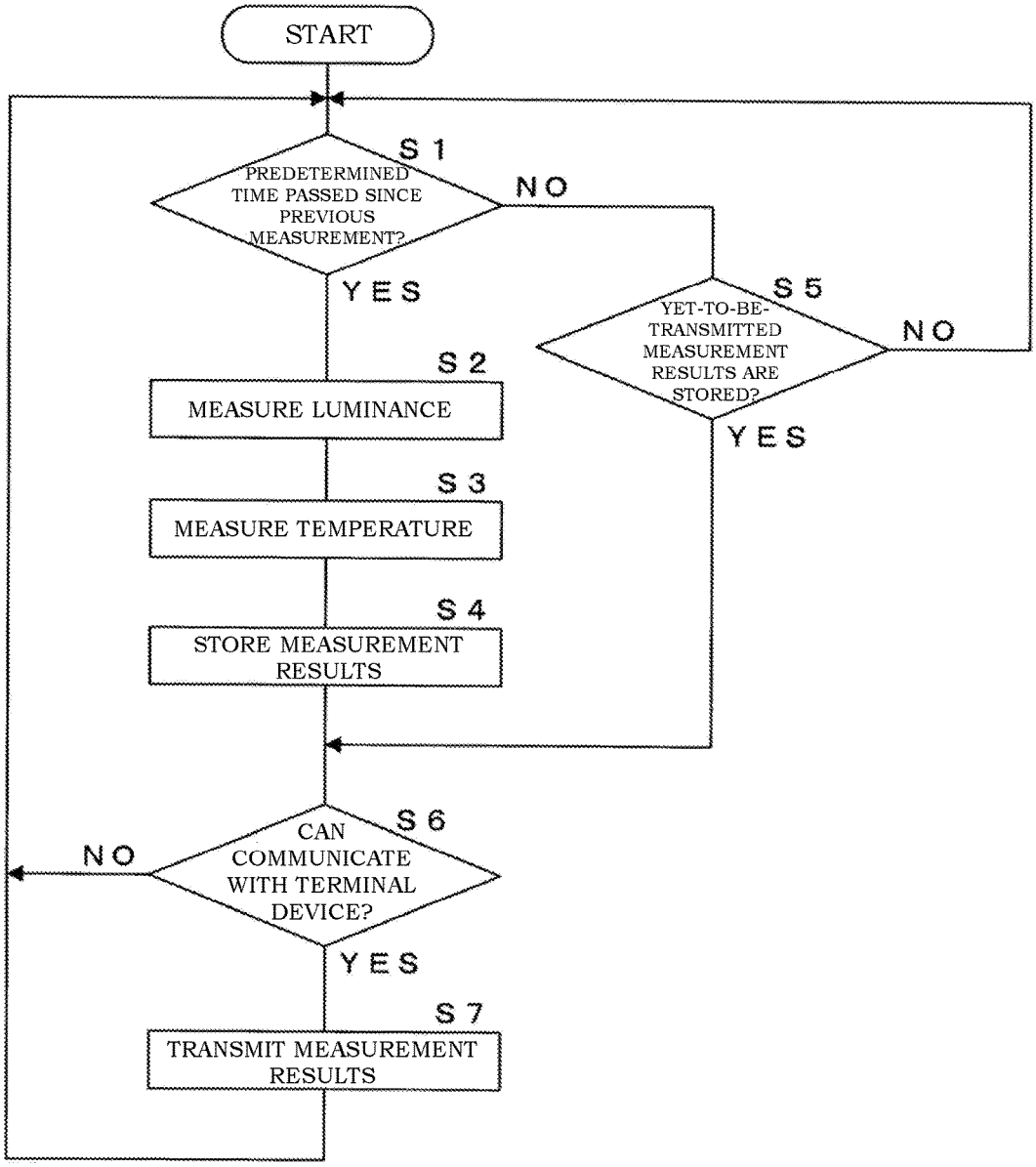
FIG. 7 is a flowchart showing the steps of a measurement process performed by a monitor.

FIG. 7 is a flowchart showing the steps of a measurement process performed by the monitor 1. The control unit 10 of the monitor 1 measures the time that has passed since the previous luminance measurement, using a timer or the like and determines whether a predetermined time has passed since the previous luminance measurement (step S1). If the predetermined time has passed since the previous luminance measurement (S1: YES), the control unit 10 makes a preparation for measurement, for example, displays a predetermined image and then measures the luminance using the optical sensor 19 (step S2). The control unit 10 also measures the temperature using the temperature sensor 20 (step S3). The control unit 10 stores the measured luminance and temperature in the storage unit 18 (step S4) and proceeds to step S6. In step S4, along with the measured luminance and temperature, the control unit 10 stores, in the storage unit 18, information such as the brightness setting when the measurement has been made and the time when the measurement has been made.

If the predetermined time has not passed since the previous luminance measurement (S1: NO), the control unit 10 determines whether yet-to-be-transmitted measurement results are stored in the storage unit 18 (step S5). If no yet-to-be-transmitted measurement results are stored (S5: NO), the control unit 10 returns to step S1. If yet-to-be-transmitted measurement results are stored (S5: YES), the control unit 10 proceeds to step S6.

The control unit 10 then determines whether the communication unit 16 can communicate with the terminal device 3 (step S6). If the communication unit 16 cannot communicate with the terminal device 3 (S5: NO), the control unit 10 returns to step S1. If the communication unit 16 can communicate with the terminal device 3 (S6: YES), the control unit 10 transmits the measurement results stored in the storage unit 18 along with the information, such as the brightness settings at the respective measurements and the dates and times of the measurements, to the terminal device 3 using the communication unit 16 (step S7), and returns to step S1.

Figure 8:
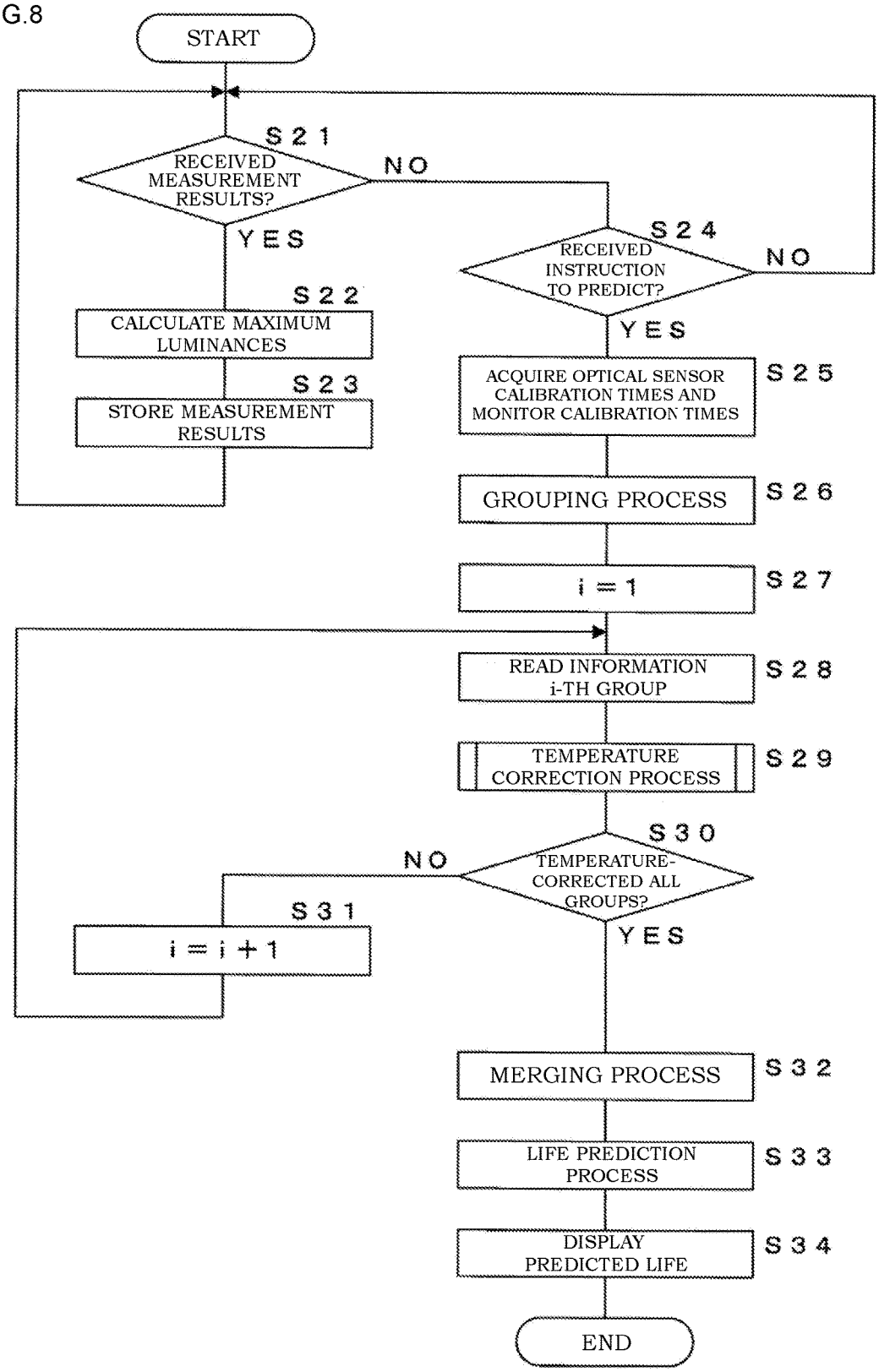
FIG. 8 is a flowchart showing the steps of a life prediction process performed by the terminal device.

FIG. 8 is a flowchart showing the steps of a life prediction process performed by the terminal device 3. The processing unit 30 of the terminal device 3 determines whether the communication unit 35 has received the measured luminances and temperatures from the monitor 1 (step S21). If the communication unit 35 has received the measured luminances and temperatures (S21: YES), the processing unit 30 calculates maximum luminances corresponding to the respective measured luminances on the basis of the received measured luminances, the information for calculating a maximum luminance (the factors a and b) transmitted from the monitor 1 along with the measurement results, and Formula (1) (step S22). The processing unit 30 stores the received measurement results and the calculated maximum luminances in the hard disk 32 (step S23) and returns to step S21. If the communication unit 35 has not received the measurement results (S21: NO), the processing unit 30 determines whether the operation unit 33 has received an instruction to predict the life of the monitor 1 (step S24). If the operation unit 33 has not received an instruction to predict the life (S24: NO), the processing unit 30 returns to step S21.

If the operation unit 33 has received an instruction to predict the life (S24: YES), the processing unit 30 acquires the calibration times of the optical sensor 19 of the monitor 1 and the monitor calibration times from the information stored in the hard disk 32 (step S25) and groups the measurement results using the acquired times (step S26). The processing unit 30 then sets the value of a variable i to 1 (step S27). The variable i is implemented by a register, memory, or the like in the processing unit 30, and the register or the like stores values for determining groups to be temperature-corrected.

The processing unit 30 then reads information, such as the maximum luminances, measured temperatures, and measurement times of the i-th group, from the information stored in the hard disk 32 (step S28). The processing unit 30 then performs a temperature correction process with respect to the i-th group on the basis of the read information (step S29). After the temperature correction process, the processing unit 30 determines whether temperature correction processes have been performed with respect to all the groups (step S30). If temperature correction processes have not been performed with respect to all the groups (S30: NO), the processing unit 30 increments the variable i by 1 (step S31), returns to step S28, and performs a temperature correction process with respect to a subsequent group.

If temperature correction processes have been performed with respect to all the groups (S30: YES), the processing unit 30 performs a merging process of merging the maximum luminance change trends of the respective groups (step S32). After the merging process, the processing unit 30 predicts the life of the monitor 1 on the basis of a linear approximation straight line obtained in the merging process and the set critical luminance (step S33) and displays the predicted life on the monitor 1 (step S34), ending the process.

Figure 9:
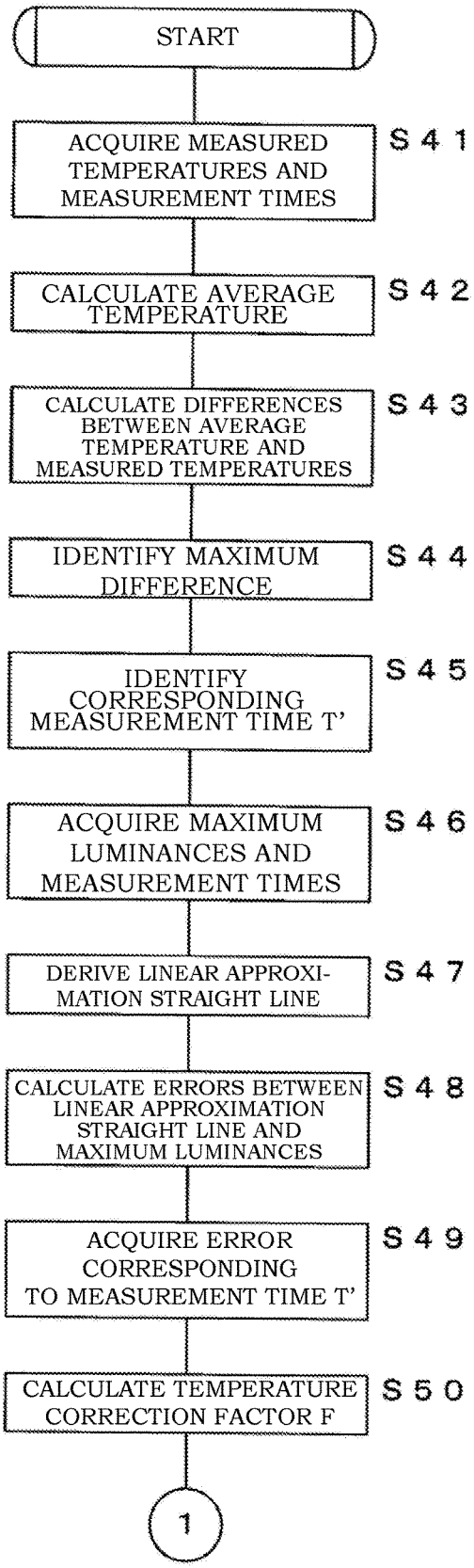
FIG. 9 is a flowchart showing the steps of a temperature correction process performed by the terminal device.
Figure 10:
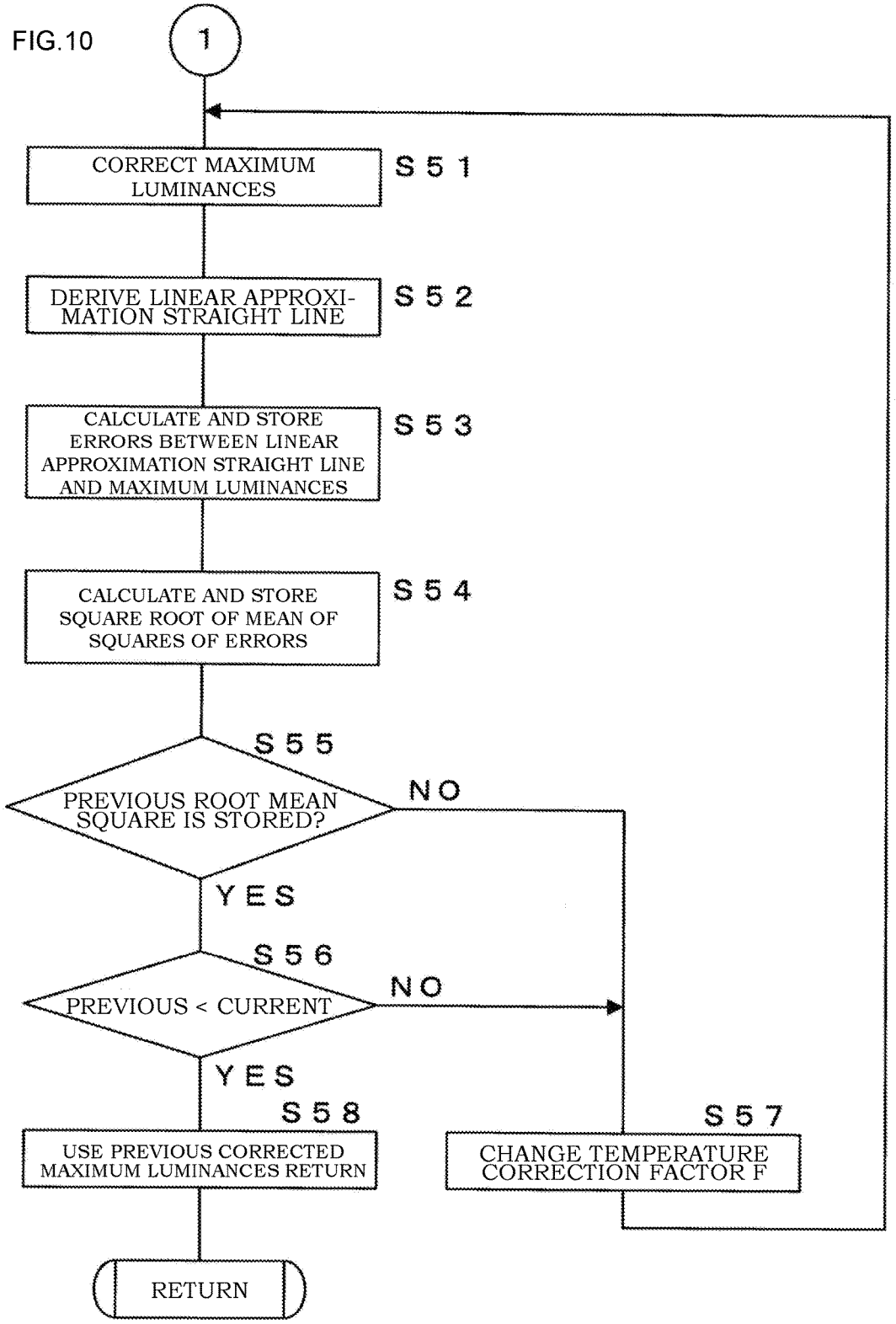
FIG. 10 is a flowchart showing the steps of a temperature correction process performed by the terminal device.

FIGS. 9 and 10 are flowcharts showing the steps of a temperature correction process performed by the terminal device 3 and show a process performed in step S29 of the flowchart of FIG. 8. The processing unit 30 of the terminal device 3 acquires information about the measured temperatures and measurement times of a group to be temperature-corrected (step S41). The processing unit 30 then calculates the average temperature on the basis of the acquired information (step S42) and calculates the differences between the calculated average temperature and the respective measured temperatures (step S43). The processing unit 30 then identifies the largest of the calculated differences as a maximum difference (step S44), as well as identifies a measurement time T' corresponding to the maximum difference (step S45).

The processing unit 30 also acquires information about the maximum luminances and measurement times of the group to be temperature-corrected (step S46). The processing unit 30 then derives a linear approximation straight line relating to the correspondence between the maximum luminances and measurement times from the acquired information (step S47) and calculates the errors between the derived linear approximation straight line and the respective maximum luminances (step S48). The processing unit 30 then acquires an error corresponding to the measurement time T' identified in step S45 from the calculated errors (step S49). The processing unit 30 calculates a correction factor $F=\Delta G(T')/\Delta Tmp(T')$ on the basis of the maximum temperature difference $\Delta Tmp(T')$ identified in step S44 and the error $\Delta G(T')$ acquired in step S49 (step S50).

The processing unit 30 then corrects the maximum luminances on the basis of the calculated correction factor F and Formula (2) above (step S51). The processing unit 30 then derives a linear approximation straight line relating to the correspondence between the corrected maximum luminances and measurement times (step S52) and calculates the errors between the derived linear approximation straight line and the respective corrected maximum luminances (step S53). The processing unit 30 then calculates the square root of the mean of the squares of the calculated errors (step S54) and stores the calculated root mean square in a memory or the like.

The processing unit 30 then determines whether the previous root mean square is stored (step S55). If the previous root mean square is stored (S55: YES), the processing unit 30 determines whether the previous root mean square is smaller than the current root mean square (step S56). If the previous root mean square is not stored (S55: NO) or if the previous root mean square is larger than the current root mean square (S56: NO), the processing unit 30 changes the value of the temperature correction factor F to an appropriate value (step S57). The processing unit 30 then returns to step S51 and repeatedly corrects the maximum luminances.

If the previous root mean square is smaller than the current root mean square (S56: YES), the processing unit 30 uses the previous corrected maximum luminances as final corrected maximum luminances (step S58), ending the temperature correction process.

In the life prediction system of the present embodiment thus configured, the monitor 1 measures the luminance (a characteristic value) of the display screen using the optical sensor 19, as well as measures the temperature around the display screen using the temperature sensor 20, and the terminal device 3 stores the measured luminance and temperature in the hard disk 32 in such a manner that the luminance and temperature are associated with each other. On the basis of the measured luminances and temperatures obtained by repeated measurements, the terminal device 3 predicts the trend of changes in the luminance assuming that the temperatures at the measurements have been approximately constant, and predicts the life of the monitor 1 on the basis of the predicted change trend. The terminal device 3 calculates the time when the luminance of the monitor 1 will fall below the critical luminance, on the basis of the predicted luminance change trend and regards this time as the time when the life of the monitor 1 will be reached. As seen above, the terminal device 3 can predict the life of the monitor 1 while reducing the dependence of the measured luminances on ambient temperature and thus can accurately predict the life of the monitor 1.

The terminal device 3 also determines the average temperature on the basis of the measured temperatures obtained by repeated measurements, calculates the differences between the average temperature and the respective measured temperatures, and calculates a maximum temperature difference from the differences. By predicting the luminance change trend of the monitor 1 on the basis of the maximum temperature difference, the terminal device 3 can predict the life of the monitor 1 considering the measurement results when the temperature difference is largest. The terminal device 3 may preset a predetermined temperature (e.g., 30° C.) rather than calculating the average temperature and perform the process using the differences between the predetermined temperature and the measured temperatures. The terminal device 3 may also perform the process using, for example, the ratios of the measured temperatures to the average temperature rather than using the differences.

The terminal device 3 also previously stores the measured luminance and temperature of the monitor 1, as well as the time when the measurements have been made. The terminal device 3 derives a linear approximation straight line relating to the correspondence between the measured luminances obtained by repeated measurements and the times of the measurements and calculates the errors between the derived linear approximation straight line and the respective measured luminances. The terminal device 3 then identifies the time when a measured temperature corresponding to the largest of the differences between the measured temperatures and the average temperature has been measured, extracts a luminance error corresponding to this measurement time, calculates a temperature correction factor F on the basis of the largest temperature difference and the luminance error, and temperature-corrects the luminances on the basis of the temperature correction factor F and Formula (2). The terminal device 3 then predicts the trend of changes in the luminance of the monitor 1 on the basis of the temperature-corrected luminances. As seen above, the terminal device 3 can correct the measurement results considering the luminance error measured at the measurement time when the temperature difference is largest and can predict the life of the monitor 1 on the basis of the temperature-corrected luminances.

Further, the terminal device 3 repeatedly performs the derivation of a linear approximation straight line, the calculation of errors, and the correction of the luminances with respect to the temperature-corrected luminances. These processes are repeated until the calculated errors satisfy a predetermined condition. For example, the predetermined condition is as follows: the square root of the mean of the squares of the calculated errors is calculated; and if the currently calculated root mean square is larger than the root mean square previously calculated in the repeated processes, the repetition of the processes is ended. The predetermined condition may also be a condition that if the calculated root mean square falls below a threshold, the repetition of the processes is ended, or may be other conditions. By repeating temperature correction, the prediction accuracy of the life of the monitor 1 can be improved. By repeatedly performing statistic analysis such as a linear approximation straight line on multiple pieces of measurement information, there can be prevented a problem that the life prediction accuracy is reduced due to a sudden change in ambient temperature. While, in the present embodiment, a linear approximation straight line is derived, other configurations may be employed. For example, the following configuration may be employed: a curve such as Lehmann's expression is employed; and a linear approximation curve, instead of a linear approximation straight line, is derived to predict the life.

Further, the terminal device 3 acquires the calibration times of the optical sensor 19 of the monitor 1 and the monitor calibration times, groups the measured luminances and temperatures into multiple groups using these times as boundaries, and temperature-corrects the luminances for the respective groups. The terminal device 3 then merges the luminances temperature-corrected for the groups and predicts the life of the monitor 1 on the basis of the trend of changes in the merged luminances. Thus, the prediction accuracy can be prevented from being reduced due to the effect of the calibration of the optical sensor 19, monitor calibration, or the like.

Further, the terminal device acquires, from the monitor 1, the luminances measured by the monitor 1, the brightness settings of the monitor 1 at the measurements, and the information for calculating a maximum luminance from a measured luminance, converts the measured luminances into maximum luminances, and predicts the change trend. Thus, the terminal device 3 can predict the maximum luminance change trend without the monitor 1 having to measure maximum luminances.

While, in the present embodiment, the monitor 1 is a liquid crystal display device that uses the liquid crystal panel 11, it may be other types of display devices. For example, the monitor 1 may be a display device that uses a plasma display panel (PDP) or the like. While the monitor 1 and terminal device 3 are different devices, other configurations may be employed. For example, there may be used a configuration in which a monitor and a terminal device are integral with each other, such as a notebook personal computer or tablet terminal. While the monitor 1 includes the optical sensor 19 for measuring the luminance, other configurations may be employed. For example, the terminal device 3 may include the optical sensor 19. The following configuration may also be employed: another device includes the optical sensor 19; and the terminal device 3 acquires the measurement results from this device. In the present embodiment, the monitor 1 transmits, to the terminal device 3, the brightness setting when the optical sensor 19 has measured the luminance. However, if a configuration is employed in which the optical sensor 19 measures a maximum luminance, there is no need to transmit the brightness setting to the terminal device 3, nor is there a need to perform an arithmetic operation using Formula (1) to calculate a maximum luminance.

In the present embodiment, the optical sensor 19 that outputs RGB values in the RGB colorimetric system is used, and the luminance is calculated from an output value of the optical sensor 19. However, other configurations may be employed. For example, the luminance may be directly acquired using an optical sensor that outputs the luminance (the amount of light). The luminance may also be derived from an output value of a sensor that outputs display intensity, such as tristimulus values in the RGB colorimetric system.

While, in the present embodiment, the life is predicted on the basis of the trend of changes in the luminance serving as a characteristic value of the monitor 1, other configurations may be employed. For example, the life may be predicted on the basis of the trend of changes in RGB values outputted by the optical sensor 19. The following configuration may also be employed: the chromaticity ($x=0.6R-0.28G-0.32B$, $y=0.2R-0.52G+0.31B$) is calculated from RGB values outputted by the optical sensor 19; and the life is predicted on the basis of the trend of changes in the chromaticity. The life may also be predicted on the basis of the trend of changes in other characteristic values. In any case, the trend of changes in such a characteristic value can be predicted in a similar manner by replacing the luminance in the above description, operational expression, and the like with RGB values, chromaticity, or the like. The characteristic value may be a value detected by a sensor or the like or may be a value calculated from this value.

In the present embodiment, the life prediction program 90 is stored in the optical disc 9, read from the optical disc 9 by the disk drive 36, and installed in the hard disk 32 of the terminal device 3. However, other configurations may be employed. For example, the terminal device 3 may download the life prediction program 90 from a server or the like through a network such as the Internet and install it in the hard disk 32.

DESCRIPTION OF REFERENCE SIGNS

1 monitor
3 terminal device
10 control unit
11 liquid crystal panel
12 panel drive unit
13 backlight
14 light drive unit
15 image signal input unit
16 communication unit
17 operation unit
18 storage unit
19 optical sensor
20 temperature sensor
30 processing unit
31 memory
32 hard disk
33 operation unit
34 image output unit
35 communication unit

The invention claimed is:

1. A method for predicting life of a display device on the basis of a display-related characteristic value of the display device, the method comprising:

repeatedly measuring a characteristic value of the display device;

measuring a temperature of the display device at the measurement in the characteristic value;

deriving, from the measured characteristic values, an approximation straight line or an approximation curve relating to correspondence between the characteristic values and measurement times of the characteristic values;

re-deriving an approximation straight line or an approximation curve from the approximation straight line or approximation curve derived and the measured characteristic values and temperatures;

predicting, on the basis of the approximation straight line or approximation curve re-derived, a trend of changes in the characteristic values assuming that the temperatures at the measurements of the characteristic values have been a particular temperature;

calculating errors between the approximation straight line or approximation curve derived and the characteristic values measured;

calculating differences between the particular temperature and the temperatures measured;

extracting a maximum temperature difference from the differences calculated;

identifying the time when a measured temperature corresponding to the maximum temperature difference extracted has been measured;

extracting a characteristic value error with respect to a characteristic value corresponding to the measurement time identified; and correcting the characteristic values measured on the basis of the maximum temperature difference extracted and the characteristic value error, wherein the re-deriving includes an approximation straight line or an approximation curve on the basis of the characteristic values corrected.

2. The method for predicting the life of claim 1, wherein the re-deriving further comprises repeatedly deriving an approximation straight line or an approximation curve until the errors calculated satisfy a predetermined condition.

3. The method for predicting the life of claim 1, wherein the particular temperature is an average temperature of the temperatures measured.

4. The method for predicting the life of claim 1, further comprising:

acquiring a calibration time of the sensor; and grouping the measured characteristic values and temperatures into a plurality of groups on the basis of the calibration time acquired, wherein the predicting includes making a prediction for each of the groups obtained.

5. The method for predicting the life of claim 1, wherein the display device displays color images and has conversion information for color-converting an input image into an output image, the method further comprising:

acquiring the time when the conversion information has been adjusted; and grouping the measured characteristic values and temperatures into a plurality of groups on the basis of the adjustment time acquired, wherein the predicting includes making a prediction for each of the groups acquired.

6. The method for predicting the life of claim 4, wherein the predicting includes merging the predictions made for the groups.

7. A non-transitory computer readable media including a life prediction program for causing a computer to predict life of a display device on the basis of a display-related characteristic value of the display device, the program causing the computer to:

acquire measured values obtained by repeatedly measuring a characteristic value of the display device and measuring a temperature of the display device at the measurement of the characteristic value;

from the measured characteristic values, derive an approximation straight line or an approximation curve relating to correspondence between the characteristic values and measurement times of the characteristic values;

re-derive an approximation straight line or an approximation curve from the approximation straight line or approximation curve and the measured characteristic values and temperatures;

on the basis of the re-derived approximation straight line or approximation curve, predict a trend of changes in the characteristic values assuming that the temperatures at the measurements of the characteristic values have been a particular temperature;

calculate errors between the approximation straight line or approximation curve derived and the characteristic values measured;

calculate differences between the particular temperature and the temperatures measured;

extract a maximum temperature difference from the differences calculated;

identify the time when a measured temperature corresponding to the maximum temperature difference extracted has been measured;

extract a characteristic value error calculated with respect to a characteristic value corresponding to the measurement time identified; and correct the characteristic values measured on the basis of the maximum temperature difference extracted and the characteristic value error extracted, wherein re-deriving an approximation straight line or approximation curve comprises re-deriving an approximation straight line or an approximation curve on the basis of the characteristic values corrected.

8. A life prediction device for predicting life of a display device on the basis of a display-related characteristic value of the display device, the device comprising:

characteristic value acquisition means configured to acquire measured characteristic values obtained by repeatedly measuring a characteristic value of the display device;

temperature acquisition means configured to acquire measured temperatures obtained by measuring a temperature of the display device at the measurement of the characteristic value;

an approximation means configured to, from the measured characteristic values, derive an approximation straight line or an approximation curve relating to correspondence between the characteristic values and measurement times of the characteristic values;

a re-approximation means configured to re-derive an approximation straight line or an approximation curve from the approximation straight line or approximation curve derived by the approximation means and the measured characteristic values and temperatures; and prediction means configured to, on the basis of the approximation straight line or approximation curve re-derived by the re-approximation means, predict a trend of changes in the characteristic values assuming that the temperatures at the measurements of the characteristic values have been a particular temperature;

characteristic value error calculation means of calculating errors between the approximation straight line or approximation curve derived and the characteristic values measured;

temperature difference calculation means of calculating differences between the particular temperature and the temperatures measured;

maximum temperature difference extraction means of extracting a maximum temperature difference from the differences calculated;

maximum temperature difference time identification means of identifying the time when a measured temperature corresponding to the maximum temperature difference extracted has been measured;

characteristic value error extraction means of extracting a characteristic value error calculated with respect to a characteristic value corresponding to the measurement time identified; and correction means of correcting the characteristic values measured on the basis of the maximum temperature difference extracted and the characteristic value error extracted, wherein the prediction means is configured to re-derive an approximation straight line or an approximation curve on the basis of the characteristic values corrected.

* * * * *